US005184991A

United States Patent [19]

Brangi

[11] Patent Number: 5,184,991

[45] Date of Patent: Feb. 9, 1993

[54] EXERCISE MACHINE

[76] Inventor: John Brangi, 73 Hillside Ave., New Haven, Conn. 06512

[21] Appl. No.: 825,028

[22] Filed: Jan. 24, 1992

[51] Int. Cl.[5] ..... A63B 21/06

[52] U.S. Cl. ..... 482/97; 482/137; 482/908

[58] Field of Search ..... 482/62, 97, 98, 99, 482/100, 106, 108, 137, 908

[56] References Cited

U.S. PATENT DOCUMENTS

| | | | |
|---|---|---|---|
| 2,921,591 | 1/1960 | Berne . | |
| 3,110.108 | 11/1963 | Hanke . | |
| 4,188,030 | 2/1980 | Hooper . | |
| 4,509,742 | 4/1985 | Cones . | |
| 4,509,746 | 4/1985 | Mask | 482/137 |
| 4,546,968 | 10/1985 | Silberman | 482/97 |
| 4,605,221 | 8/1986 | D'Agosta . | |
| 4,616,825 | 10/1986 | Anderson . | |
| 4,621,810 | 11/1986 | Cummins . | |
| 4,627,619 | 12/1986 | Rockwell et al. . | |
| 4,645,200 | 2/1987 | Hix | 482/62 |
| 4,813,666 | 3/1989 | Costilow et al. | 482/97 X |
| 4,883,269 | 11/1989 | Shaver | 482/97 |
| 4,962,925 | 10/1990 | Chang . | |
| 5,066,003 | 11/1991 | Jones | 482/137 |
| 5,098,361 | 3/1992 | Danylieko | 482/97 |

OTHER PUBLICATIONS

Advertisement For "Buckeye Barbell" In Muscle & Fitness, Jun., 1987.

*Primary Examiner*—Robert Bahr
*Attorney, Agent, or Firm*—DeLio & Associates

[57] ABSTRACT

An exercise device comprises a frame having a seat mounted thereon and a pair of handlebars extending rearwardly from and pivotally attached to the frame at a point forward of the seat, each of the handlebars being individually moveable back and forth by the arms of a user of the device. A foot pedal is rigidly attached to and extends rearwardly from each of the handlebars, each foot pedal being individually moveable down and up by the legs of a user of the device. A weight platform is rigidly attached to each of the handlebars for supporting individual weights, the weight platform extending forwardly of the pivot point. The weight platform is raised and lowered in an arc around the pivot point upon back and forth movement of the handlebars. The user when seated on the seat may exercise his individual arms and/or legs against resistance of raising and lowering selected weights on the weight platform by respective movement of the individual handlebars in a back and forth direction and individual foot pedals in an down and up direction.

10 Claims, 2 Drawing Sheets

FIG. 2
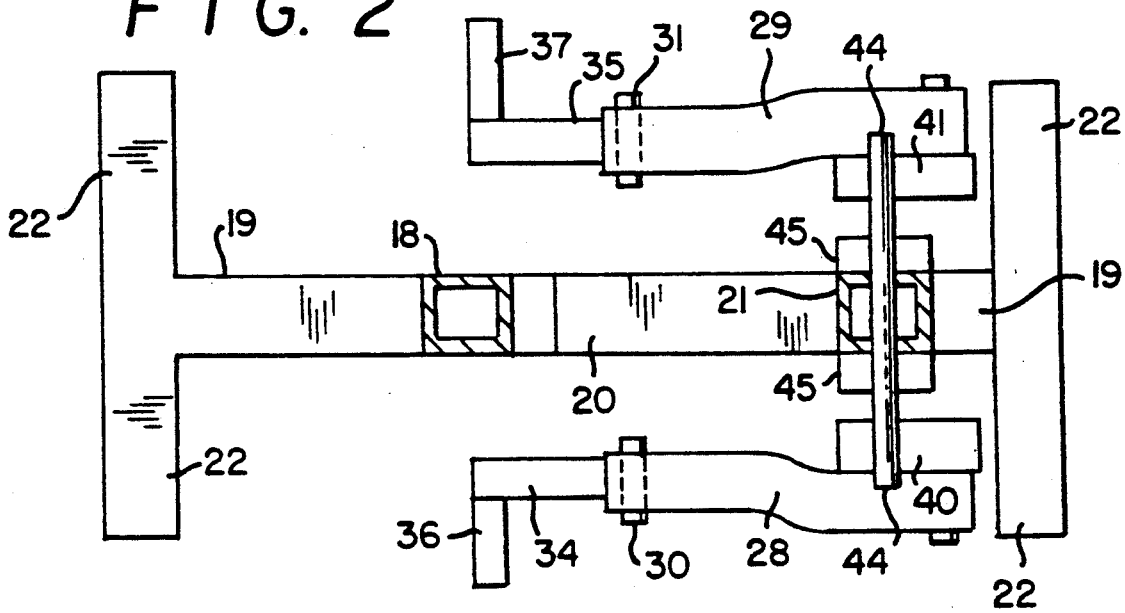
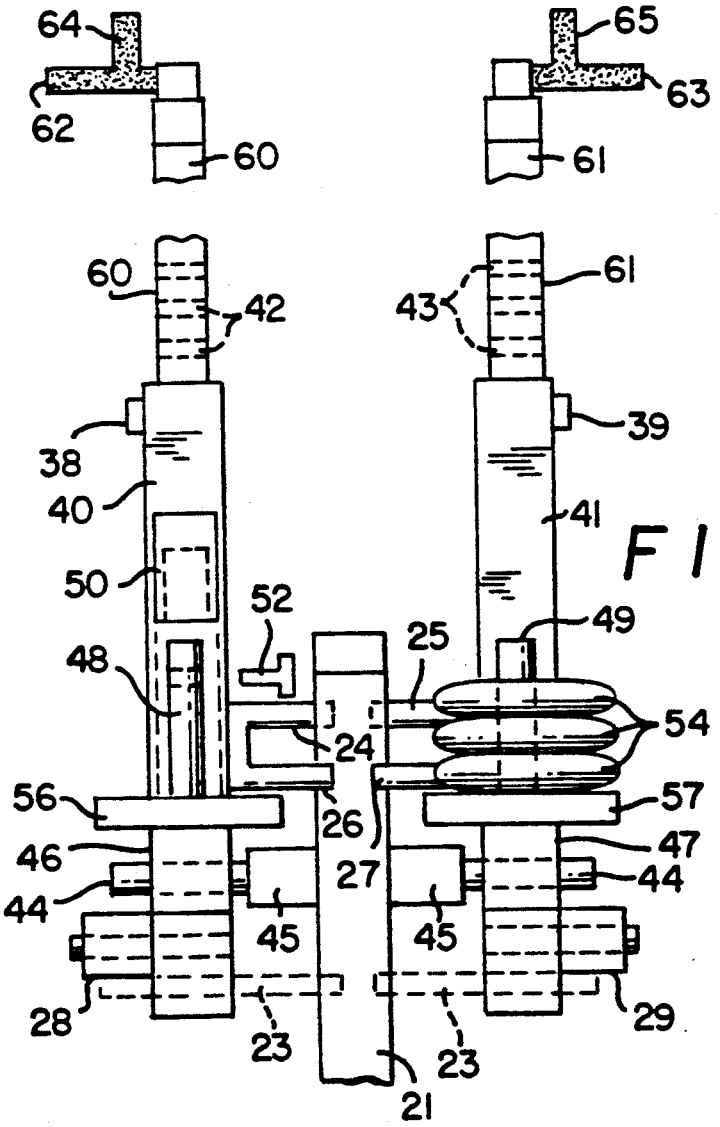
FIG. 3

EXERCISE MACHINE

BACKGROUND OF THE INVENTION

The present invention is directed to an exercise device, in particular, to a device which exercises the arms and/or legs of a person.

Bicycle type exercise devices are popular because they provide a good seating arrangement for exercising a person's legs, generally through resistance applied to rotation of the crank on which the foot pedals are mounted. Some bicycle type exercise devices also provide for simultaneous exercise of the arms as illustrated by U.S. Pat. Nos. 4,188,030 and 4,962,925. Both of these devices have interconnected handlebars and foot pedals which provide for simultaneous opposing motion of the arms and legs on each side of the user's body.

It is desirable to be able to exercise one's arms and/or legs individually on each side of the body, as an alternative to simultaneous (usually opposing) exercise of both arms and/or legs. Also, it would be desirable to be able to set the resistance independently for each side of the body. This would permit individual attention to the various muscle groups of the body according to the needs of the user. Prior art bicycle type exercise devices have not provided for such independently selected resistance to the arms and/or legs on each side of the body. Furthermore, it is desirable for the device to provide a constant resistance to motion, such as that achieved by lifting weights, and for user to be able utilize the individual barbell type weights which he or she may already own. Prior art bicycle type exercise devices have not provided for such.

Bearing in mind the problems and deficiencies of the prior art, it is therefore an object of the present invention to provide an exercise device in which the user is able to individually and independently exercise the arms and/or legs on each side of the his body.

It is another object of the present invention to provide an exercise device which utilizes the principle of lifting weights against gravity to provide resistance to movement.

It is a further object of the present invention to provide an exercise device which utilizes individual weights of the type employed with barbells to provide resistance.

It is yet another object of the present invention to provide an exercise device meeting one or more of the above objects which utilizes bicycle type seating.

It is a further object of the present invention to provide an exercise device meeting one or more of the above objects which is relatively simple and low cost in manufacture.

SUMMARY OF THE INVENTION

The above and other objects, which will be apparent to those skilled in the art, are achieved in the present invention which is directed to an exercise device which comprises a frame having a seat mounted thereon and a pair of handlebars having handgrips thereon extending rearwardly and/or upwardly from and pivotally attached to the frame at a point forward of and/or below the seat, each of the handlebars being individually moveable back and forth by the arms of a user of the device. A weight platform which extends forward from the handlebar pivot point is rigidly connected to each of the handlebars for supporting individual weights. The weight platform is raised and lowered in an arc around the pivot point upon back and forth movement of the handlebars. Means are provided on the device for limiting movement of each of the handlebars between defined forward and back limits.

The user, when seated on the seat, may exercise his individual arms against resistance of raising and lowering selected weights on the weight platform by grasping the handgrips with his hands for respective opposite movement of the individual handlebars in a back and forth direction.

Optionally, a foot pedal is rigidly connected to each of the handlebars and extends rearward therefrom to below the seat, each foot pedal being individually moveable down and up by the legs of a user of the device to assist in raising and lowering the weights.

The weight platform preferably includes a shaft which extends upwardly from the platform for receiving conventional weight disks or plates, and may include shafts of varying diameter for receiving different configurations of weight disks or plates.

BRIEF DESCRIPTION OF THE DRAWINGS

FIG. 2 is a sectional view of the device looking downward along lines 2—2 as shown in FIG. 1.

FIG. 3 is an elevational view of the front portion of the device as seen along lines 3—3 of FIG. 1.

DETAILED DESCRIPTION OF THE INVENTION

Figure 1:
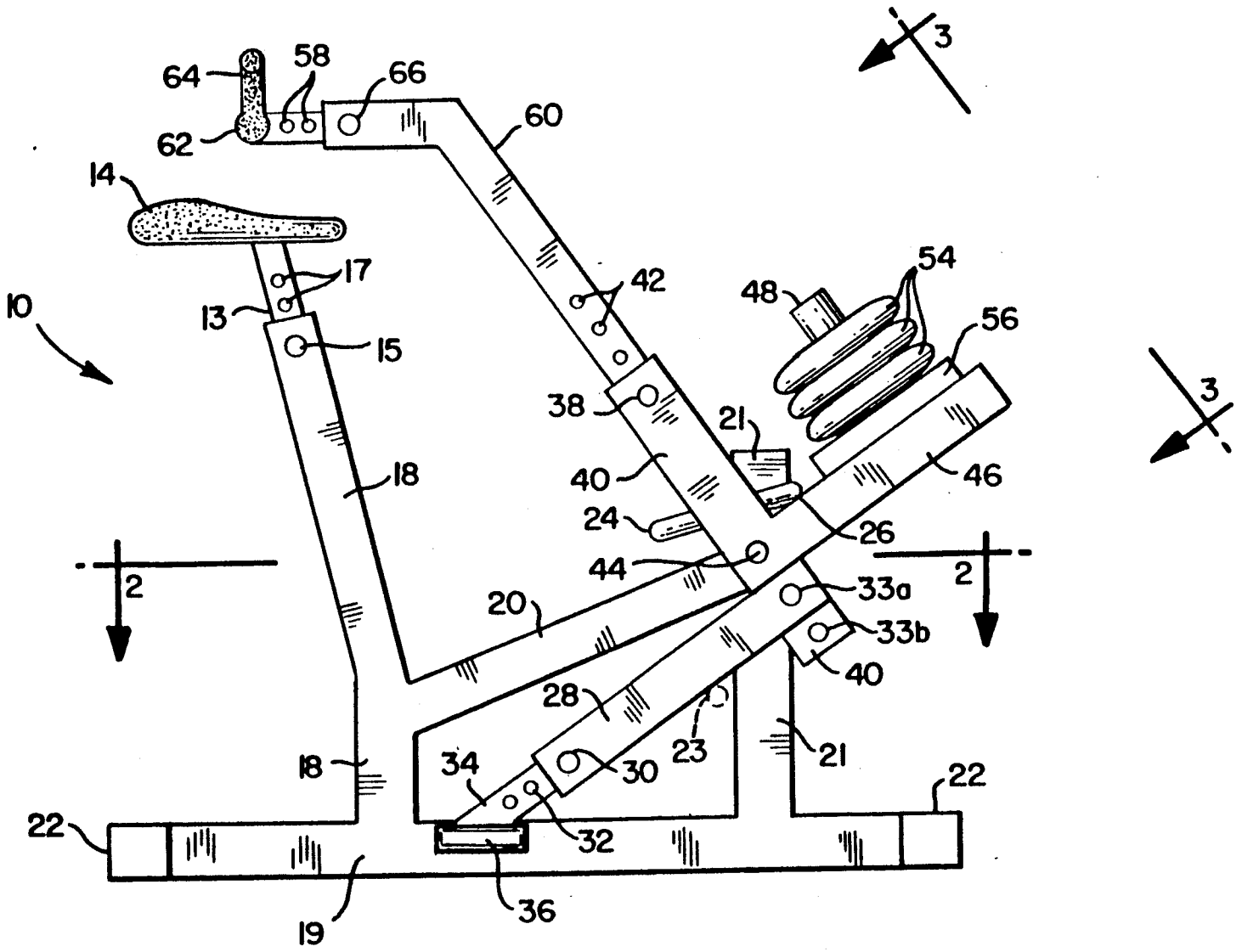
FIG. 1 is a side elevational view of the preferred exercise device of the present invention.

The preferred embodiment of the present invention is described herein with reference to drawing FIGS. 1–3 in which like numerals refer to like features of the invention. Features of the invention are not necessarily shown to scale. Unless otherwise noted, all features are made of rugged structural material such as steel, aluminum, or rigid plastic. For frame and other support members, square cross-section tubing is preferred.

The exercise device 10 consists generally of a lower longitudinal frame member 19 having transverse members or feet 22 at opposing end thereof. Extending substantially vertically from the mid-section of member 19 is frame member 18 which at its upper end receives seat post 13 upon which a bicycle seat 14 is disposed. A plurality of spaced seat support holes 17 are provided through which seat support 15 pin may be placed in member 18 to adjust the height of the seat as desired. This provides bicycle-type seating to the user in which, as shown in FIG. 1, the user's body is facing to the right. As used herein, "bicycle-type seating" is used to refer to a relatively narrow seat, such as the type employed in conventional two wheel bicycles, on which the user sits and straddles with his legs in order to be able to move and exercise his arms and legs.

Extending upwards from frame 19 at a location forward of frame member 18 is vertical member or post 21. Frame member 20 connects a mid-section of member 21 with a mid-section of member 18 for increased rigidity of the frame. As seen best in FIGS. 2 and 3, a horizontal shaft or axle 44 extends outwardly on either side of post 21, being secured thereto by frame connector members 45. Shaft 44 is disposed below and forward of seat 14 and provides the pivot point around which the handlebars, foot pedals and weight platforms rotate in limited arcs, as will be further explained below.

Rotatably disposed on shaft 44 on the right side of exercise device 10 is an arm 40 and arm extension 60 which comprise the right side handlebar of the device. This handlebar extends generally upwardly and rearwardly from shaft 44, the extension length of which may be adjusted by insertion of pin 38 into a selected spaced hole 42 in arm extension 60. At the upper end of arm extension 60 and extending horizontally and rearwardly therefrom is the right handle which comprises a horizontal handle portion 62 and a vertical handle portion 64, the positions of which may be adjusted by insertion of handle support pin 66 through the desired spaced handle adjustment hole 58. A similar handlebar arrangement with identical features is provided on the left side of exercise device 10 in which arm 41 is pivotally connected at its lower end to shaft 44 and extends upwardly therefrom. An arm extension 61 is adjustable by pin 39 through adjustment holes 43. Horizontal and vertical handles 63 and 65, respectively, are adjustable with respect to the upper end of arm extension 61.

Extending forwardly away from and connected rigidly to each of the handlebars are right and left weight support members 46 and 47, respectively. Weight support members 46 and 47 are attached near the lower ends of arms 40 and 41, respectively, and extend generally forward and away from the arms and shaft. Weight support plates 56, 57 are provided on the weight support members. Extending vertically upward from weight support plates 56 and 57 are weight mounting shafts 48 and 49, respectively. The weight mounting shafts are adapted to receive the central openings of conventional weight plates or discs 54 of the type which are used on barbells or other weight equipment. Since each handlebar and associated weight support member moves independently of the other, the user may select the desired weight and number of individual weights 54 for each side of the device 10. As seen in side view, when each weight platform 56 or 57 is loaded with the desired number of weights, it may be independently raised and lowered in an arc around shaft pivot 44 upon respective back and forth movement of each of the handlebar assemblies.

Since home or professional type weights 54 may have different diameter openings, a larger diameter sleeve 50 may be provided to accommodate the various configurations of weight discs or plates. A pin 52 may be placed through an opening in the upper end of shaft 48, 49 to hold the weights 54 securely in place during use.

A foot pedal assembly is provided for each of the handlebars assemblies to enable the user's feet to move the weights up and down. As seen on the right side of device 10, foot bar 28 is rigidly connected to the handlebar assembly by attachment with fastener 33*a* near the lower end of arm 40. Alternatively, foot bar 28 may be positioned lower along arm 40 by connection with fastener 33*b*. Foot bar 28 extends generally rearwardly and downwardly and receives a foot pedal extension 34 upon which foot pedal 36 is mounted. A series of spaced adjustment holes 32 are formed in pedal extension 34 such that pin 30 may adjust the location of pedal 36 as desired by the user. Likewise, on the left side of device 10, foot bar 29 extends rearwardly and downwardly from rigid connection to the lower end of arm 41, and secures pedal extension 35, on which foot pedal 37 is mounted, at a desired location by pin 31.

To limit movement of each of the handlebars assemblies and associated weight support members and platforms between defined limits, U-shaped stop bars 24, 26 and 25, 27 are attached to the inner sides of arms 40 and 41 respectively. The respective arms 24, 26 and 25, 27 of the stop bars extend inwardly and contact the front and back sections of the upper end of frame member 21 when the forward and rear limits of movements of handlebars are reached. Alternatively, a stop bar 23 may be provided on foot bars 28, 29 to contact frame members 20 and 21 to limit movement of the foot bar and handlebar assemblies.

In operation, the user sits atop seat 14 with legs straddling frame members 18 and 20 and places his right and left feet respectively on foot pedals 36 and 37. The user's right and left hands grip either horizontal handles 62, 63 or vertical handles 64, 65 respectively. Resistance against movement of the individual handlebars in a back and forth direction is provided by respectively raising and lowering each individual right and left weight platform with associated weight(s) mounted thereon. Alternatively, or in conjunction with movement of the handlebars, the individual foot pedals are moved in a down and up direction to raise and lower the weight platforms. Thus, the individual user may exercise his right arm and leg independently from his left arm and leg. Additionally, the user has a choice of exercising either his legs or arms alone or in conjunction with each other, as desired.

Thus, the present invention meets the objects recited above and provides a simple, easy-to-manufacture bicycle type exercise device in which the users arms and legs may be individually exercised against the resistance of raising and lowering selected weights.

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. An exercise device comprising:

a frame having a seat mounted thereon;

a pair of handlebars extending upwardly from and pivotally attached to said frame at a point forward of said seat, each of said handlebars being individually moveable back and forth by the arms of a user of said device;

a foot pedal rigidly attached to and extending rearwardly from each of said handlebars, each foot pedal being individually moveable down and up by the legs of a user of said device; and a weight platform rigidly attached to each of said handlebars for supporting individual weights, said weight platform being raised and lowered in an arc around said pivot point upon back and forth movement of said handlebars;

whereby said user seated on said seat may exercise his individual arms and/or legs against resistance of raising and lowering selected weights on said weight platform by respective movement of the individual handlebars in a back and forth direction and individual foot pedals in an down and up direction.

2. The exercise device of claim 1 wherein said weight platform includes a shaft for receiving weight disks or plates.

3. The exercise device of claim 2 wherein said weight platform includes shafts of varying diameter for receiving different configurations of weight disks or plates.

4. The exercise device of claim 2 wherein said weight shaft extends upwardly from said platform.

5. The exercise device of claim 2 wherein said handlebar pivot point is below and forward of said seat.

6. The exercise device of claim 1 further including means on said frame for limiting movement of each of said handlebars between defined forward and rear limits.

7. An exercise device comprising:

a frame having a seat mounted thereon;

a pair of handlebars having handgrips thereon extending upwardly from and pivotally attached to said frame at a point forward of and below said seat, each of said handlebars being individually moveable back and forth by the arms of a user of said device;

a weight platform rigidly connected to each of said handlebars for supporting individual weights, said weight platform extending forward from the handlebar pivot point;

means on said frame for limiting movement of each of said handlebars between defined limits; and a foot pedal rigidly connected to each of said handlebars and extending rearward therefrom to below said seat, each foot pedal being individually moveable down and up by the legs of a user of said device to assist in raising and lowering said weights, respectively, whereby said user seated on said seat may exercise his individual arms against resistance of raising and lowering selected weights on said weight platform by grasping said handgrips with this hands for respective opposite movement of the individual handlebars in a back and forth direction.

8. The exercise device of claim 7 wherein said weight platform includes a shaft for receiving weight disks or plates.

9. The exercise device of claim 8 wherein said weight platform includes shafts of varying diameter for receiving different configurations of weight disks or plates.

10. The exercise device of claim 8 wherein said weight shaft extends upwardly from said platform.

* * * * *